US005749564A

United States Patent [19]

Malek

[11] Patent Number: 5,749,564

[45] Date of Patent: May 12, 1998

[54] STAPLE REMOVING DEVICE

[76] Inventor: Shahin Shane Malek, 45 Rapp Rd., Albany, N.Y. 12203

[21] Appl. No.: 706,239

[22] Filed: Sep. 4, 1996

[51] Int. Cl.[6] ..... B25C 11/00

[52] U.S. Cl. ..... 254/28

[58] Field of Search ..... 254/28; 30/162; 227/63; D8/48; 29/268

[56] References Cited

U.S. PATENT DOCUMENTS

| | | | |
|---|---|---|---|
| 1,956,166 | 4/1934 | Cavanaugh | 254/28 |
| 2,539,171 | 1/1951 | Yerkes | 254/28 |
| 2,567,021 | 9/1951 | Maynard | 254/28 |
| 2,592,570 | 4/1952 | Hofstetter | 254/28 |
| 2,662,727 | 12/1953 | Yerkes | 254/28 |
| 2,675,989 | 4/1954 | Vogel | 254/28 |
| 5,299,355 | 4/1994 | Boda et al. | 30/162 |

*Primary Examiner*—Robert C. Watson
*Attorney, Agent, or Firm*—Jay R. Yablon

[57] ABSTRACT

A device for removing staples from papers, cloth, or other material without tearing or mutilating the material. The device utilizes a heel of palm to finger gripping action to facilitate a more natural action for removing staples. Staples are extracted by way of a jaw which opposes a wedge-shaped piece to an abutting plate piece, which straightens the staple while simultaneously pulling it out of the paper in a perpendicular direction. The wedge-shaped piece includes a portion where its width and thickness increase to dimensions wherein the sum of the width plus twice the thickness exceeds the total length of the three sides of the staples being removed, thus facilitating complete extraction.

20 Claims, 4 Drawing Sheets

STAPLE REMOVING DEVICE

The present invention generally relates to devices for removing staples. More particularly, the present invention relates to a device for removing staples from paper, cloth, or other material without tearing the material.

BACKGROUND OF THE INVENTION

1. Technical Field

Due to the common use of staples as fasteners, staple removers may be found in almost any office and in many other settings, such as offices or interior design applications. For example, many times staples must be removed to allow papers to be individually copied or to insert an edited form or page. Whatever the reason for wanting to remove a staple from papers, cloth, or other material, it is usually desirable to do so without tearing or mutilating the material being held together or in place.

Pulling staples manually from materials such as sheet papers is not only extremely inconvenient, but can rarely be accomplished without tearing or mutilation of the stapled material. Thus, various devices have been invented to facilitate easier removal of staples.

Most staple removers require further pulling of the staple after the remover has engaged the staple. Thus, use of these devices often results in tearing of the stapled material.

A further problem with many staple removers is their small size and the manner of gripping them for use. Since many staple removers utilize either a "plier-type" gripping action or a "thumb to finger" action the user must pick-up the stapled material, such as papers, in order to achieve a comfortable angle for use of the staple remover. Furthermore, these types of grips naturally facilitate the tendency of users to pull the remover away from the material, thus increasing the chance of tearing.

2. Background Art

Typical staple remover devices for removing staples from paper are disclosed in U.S. Pat. No. 1,922,681 Heise, U.S. Pat. No. 2,678,575 to Marano, U.S. Pat. No. 2,431,922 to Curtiss, and in U.K. Patent No. 862,468 to Balma et al. and Italian Patent No. 1,220,438 to Balma, et al.

The staple remover disclosed by Heise (U.S. Pat. No. 1,922,681) utilizes two hinged members with a pair of jaws on one end and a pair of handles on the other. This device utilizes a thin blade and a prong engaging portion to pull the staple from the pages. Thus, the staple is dragged by the engaging portion across the length of the blade as it is removed. Although this may decrease mutilation of papers resulting from manual extraction of staples, it may not do so adequately since the staple is extracted at an angle rather than being lifted out in a perpendicular direction.

U.S. Pat. No. 2,678,575 to Marano reveals a plier-type implement with a pair of elongated members secured together at one end, and normally divergent at their other ends. This device, like Heise, utilizes a thin blade opposed to a prong engaging portion to pull the staple from the pages, and presents roughly the same difficulties. Since the blade is thin, the staple is straightened by pulling it across an abutment at an angle, thus increasing the likelihood of tearing.

The staple remover disclosed by Curtiss (U.S. Pat. No. 2,431,922) involves two elongated arms pivotally attached at one end and normally divergent at their other ends due to the bias created by the free ends of a spring located about the pivot. This device removes a staple by engaging the top portion of the staple with notches and flanges on the lower arm, and then utilizing a thin blade and flanges on the upper arm to pull the staple while simultaneously straightening its legs.

U.K. Patent No. 862,468 to Balma, et al. discloses a plier-like device for detaching metallic staples. (See also Italian Patent 1,220,438 to Balma, et al.) This device utilizes a tapered tongue-like projection of substantially triangular configuration which may be tapered with respect to its width and with respect to its thickness attached to one side of the jaws, and uses an abutting means on the other side of the jaws to extract the staple. It extracts staples by driving the tapered-tongue like projection underneath the top portion of a staple with an abutting means when the handles of the device are squeezed together.

All of these devices are operated horizontally by gripping their handles with the thumb on top and the fingers underneath in a grip similar to that used in operating pliers or scissors. The Curtiss device could be operated vertically with a heel of the palm to finger grip, but is not designed to comfortably accommodate such use.

This plier-type grip is less comfortable than a heel of the palm to finger grip when operating a staple remover in a vertical position. Furthermore, operators are more likely to pull on the staple remover device when operating a device horizontally using a plier-type grip than when operating a device vertically using a heel of the palm to finger grip.

Therefore, a need exists for a staple removing device that completely removes the staple without requiring additional pulling away from the paper, cloth, or other material after the device engages the staple, and which will remove the staple without tearing or mutilating the paper, cloth, or other material. Also, there is a need for a staple remover that may be more comfortably and naturally used, and that minimizes the tendency of the user to pull the remover away from the paper prior to complete extraction of the staple. The aforementioned art is hereby incorporated by reference.

SUMMARY OF THE INVENTION

The present invention addresses the need for a staple remover that minimizes the tendency to pull the staple away from the paper before it has been completely straightened. It also minimizes tearing of the stapled papers when the staple is extracted.

The present invention provides, in its first aspect, a staple remover device utilizing two arms pivotally attached to each other at their ends. It further provides a wedge-shaped piece where sum of lengths of three sides at its thickest point exceeds the length of the three sides of a standard staple (22 millimeters), thus straightening and removing staples completely. It also provides a finger grip and a finger guard which facilitate comfortable and efficient use of the device.

It is therefore an advantage of the present invention to have a series of depressions on the upper arm designed to facilitate more comfortable and more efficient removal of staples by allowing the staple remover to be operated in a vertical rather than a horizontal position.

It is therefore a further advantage of the present invention to provide a finger guard whereby the finger of the user are protected while holding the staple remover.

It is therefore a further advantage of the present invention to provide a wedge versus abutment jaw which includes a wedge shaped piece where the sum of lengths of the top three sides at its thickest point exceeds the length of the three sides of a standard staple.

It is a further advantage of this invention to provide a staple remover which includes a geometry to remove a staple without tearing the paper, wherein the staple is entirely removed from the paper by a wedge-shaped piece having an arc thereon. This allows the remover to slide easily under the staple.

BRIEF DESCRIPTION OF THE DRAWINGS

These and other advantages of the present invention will become more readily apparent upon reading the following detailed description and upon reference to the drawings in which.

DETAILED DESCRIPTION OF THE PREFERRED EMBODIMENTS

Figure 1:
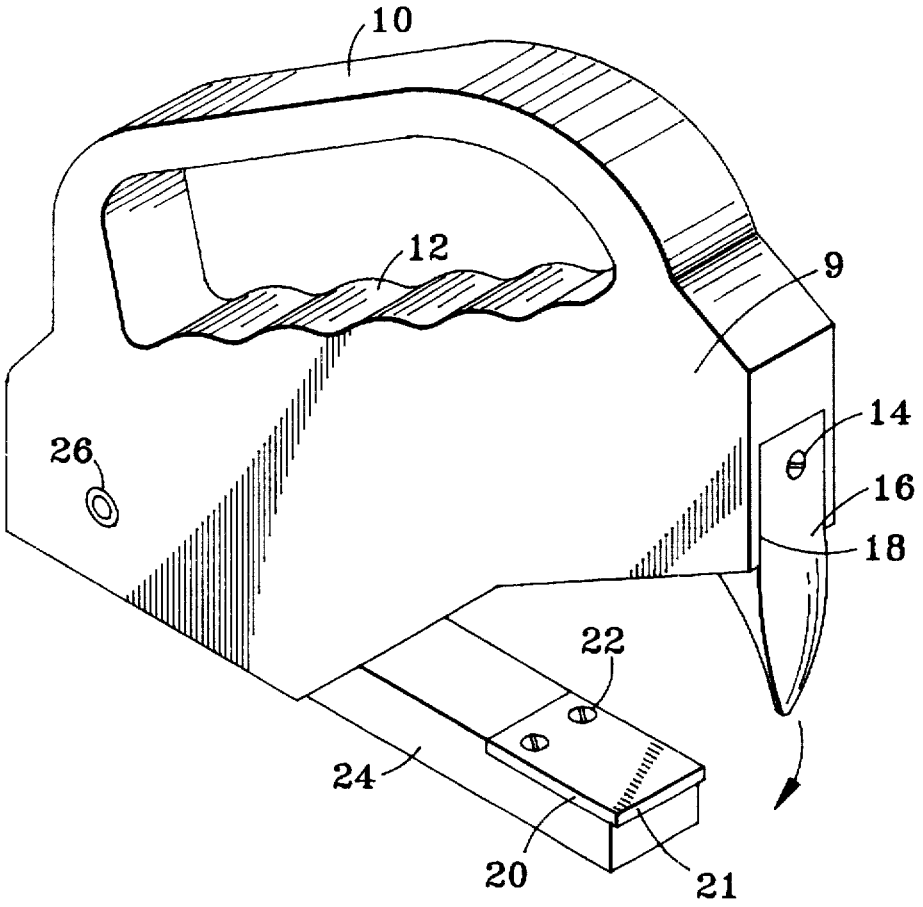
FIG. 1 is a side perspective view of the first preferred embodiment.

Referring to FIG. 1, there is illustrated a staple-remover device, in accordance with the first preferred embodiment of the present invention. The device includes a first arm 9 and a second arm 24, which are held together at one end by a pivoting means 26. The first arm includes a series of depressions 12 to facilitate gripping when the device is operated in a vertical position with the heel of the palm against the bottom of the second arm 24 and the fingers positioned in the series of depressions 12. The first arm 9 also includes a finger guard 10 to protect the operator's fingers during use of the device.

Attached to an indentation 18 in the first arm 9 is a wedge-shaped piece 16. This piece is held tightly to the first arm 9 by means of a screw 14.

The second arm 24 is an elongated piece that may be u-shaped or channel shaped in the transverse. Attached to an indentation 21 in the second arm 24 is a plate 20 made of hard material such as metal, which slightly exceeds the end of the second arm 24. This plate is held tightly in place by means of screws 22.

Figure 2:
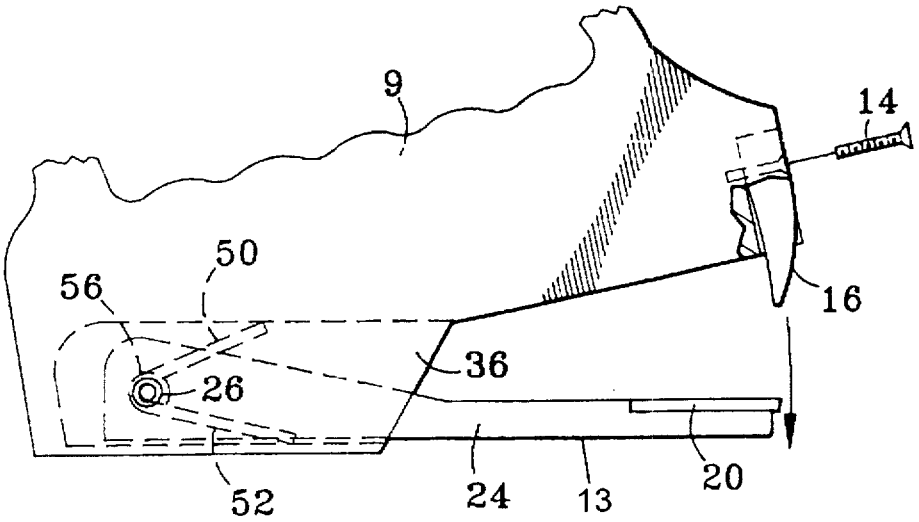
FIG. 2 is a side view of the first preferred embodiment with the arms in their natural open position.

Referring to FIG. 2, a side view of the staple remover is shown in accordance with the first preferred embodiment of the invention. This view depicts the staple remover in its natural or open position with the first arm 9 diverging from the second arm 24 at one end. In this position, the bias of the spring 56 as exerted through the second spring end 50 and the first spring end 52 holds the first arm 9 and the second arm 24 apart.

As depicted, second spring end 50 presses against the interior end surface of the female slot 36 of first arm 9. The first spring end 52 presses against the interior surface of the second arm 24. In this position the bottom surface of the female slot 36 of the first arm 9 is parallel to the second arm 24.

Figure 3:
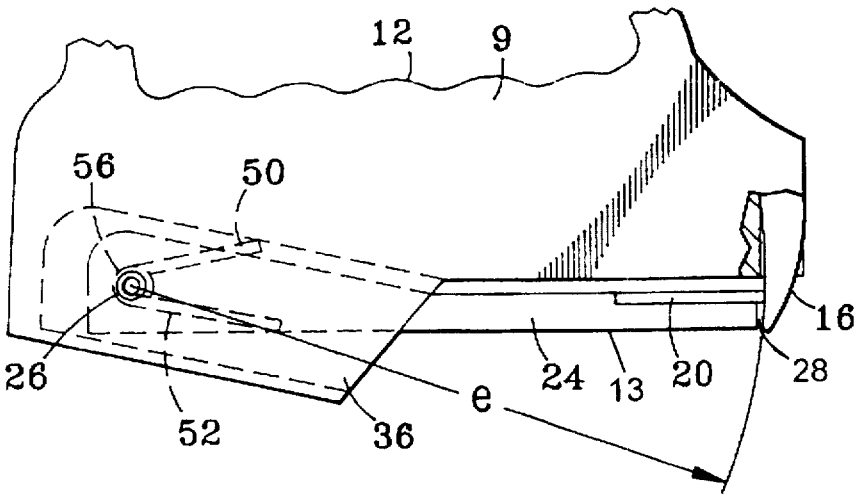
FIG. 3 is a side view of the first preferred embodiment with the arms closed to show the interaction of the wedge-shaped piece and the plate.

Referring to FIG. 3, a side view of the staple remover is shown, in accordance with the first preferred embodiment of the invention. This view depicts the first arm 9 as it appears when it has been squeezed against the second arm 24.

In this closed position, the wedge-shaped piece 16 abuts the plate 20. Furthermore, the female slot 36 of first arm 9 exerts pressure against the second spring end 50, thus decreasing the distance between the second spring end 50 and the first spring end 52. The spring 56 is also depicted, being held in place by the pivoting means 26.

The staple remover is typically operated in the vertical position as shown, with the heel of the user's palm pushing against the second arm 24, and the user's fingers utilizing the series of depressions 12 to pull on the first arm 9.

Figure 4:
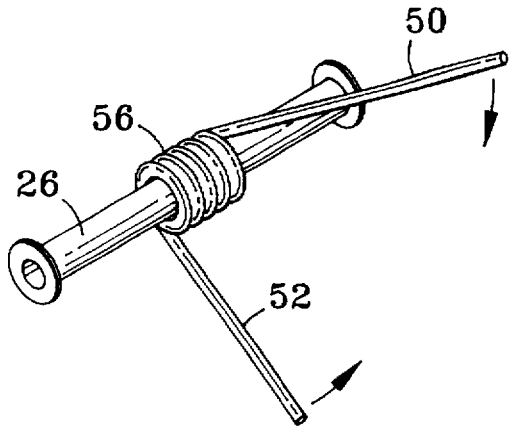
FIG. 4 is a depiction of the spring apparatus positioned around the pivot apparatus.

Referring to FIG. 4, the spring 56 is depicted. As shown, the spring is held in place by the pivoting means 26 which penetrates spring's 56 hollow center.

Figure 5:
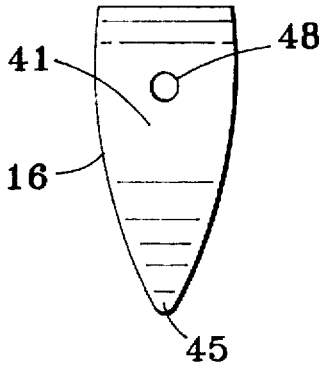
FIG. 5 is a front view of the first preferred embodiment of the wedge-shaped piece.
Figure 6:
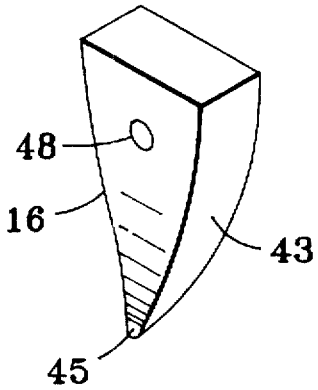
FIG. 6 is a back perspective view of the first preferred embodiment of the wedge-shaped piece.

Referring to FIGS. 5 and 6, the wedge-shaped piece 16 is depicted in accordance with the first preferred embodiment of the invention. This wedge-shaped piece 16 is substantially triangular in shape at one end, and rectangular in shape at the other end. The piece both widens and thickens from the tip 45 towards its central region, to a width and a thickness wherein the sum of the width plus twice the thickness at this central region exceeds the total length of the three sides of the staple to be removed (which, for a standard staple, is 22 millimeters=12 millimeters+5 millimeters+5 millimeters), and ensures that the staple legs will be gradually straightened (unfolded) and the staple will then fully and cleanly removed when the two arms of this device are pressed together as in FIG. 3. At this point, the wedge-shaped piece 16 becomes rectangular.

The front surface 41 of the wedge-shaped piece 16 curves down to the tip 45 on one side and is flat on the other. A hole 48 provides a means whereby the wedge-shaped piece 16 may be attached to the staple remover with a screw or other fastening device.

FIG. 6, depicts a perspective view of the wedge-shaped piece 16. The front surface 43 must be arced with the arc having a radius of curvature determined such that the origin of the arc coincides substantially with the position of said pivot point, and the wedge-shaped piece 16 widens and thickens from the tip toward its central region as shown, with the thickening occurring on its rear surface opposite the front surface 43 (see also, FIG. 2). Thus, when the remover arms are pressed together as shown in FIG. 3, the plate will be perpendicular to a line tangent to the arc of the wedge-shaped piece at the point of closest proximity between the wedge-shaped piece 16 and the plate 20, and these pieces 16 and 20 will thereby maintain a small, substantially fixed distance (less than the gauge thickness of a staple) from one another throughout the movement of the wedge-shaped piece 16 past the plate 20. This view also depicts a hole 48 for attachment.

Figure 7:
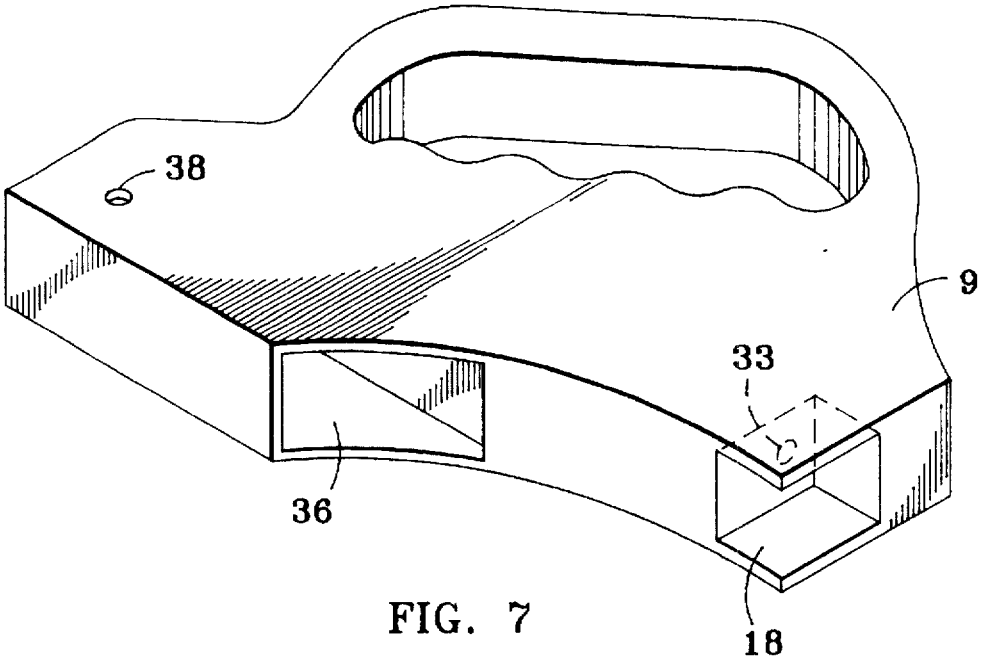
FIG. 7 is a perspective view of the top arm of the first preferred embodiment.

Referring to FIG. 7, a perspective view of the first arm 9 is shown in accordance with the first preferred embodiment of the invention. A female slot 36 is revealed whereby first leg 24 may be inserted and attached. This figure also depicts the indentation 18 to which the wedge-shaped piece 16 may be attached by means of a screw inserted into attachment hole 33. Two holes 38 are also provided on the back portion of the first arm 9 whereby a pivoting means 26 may be inserted.

Figure 8:
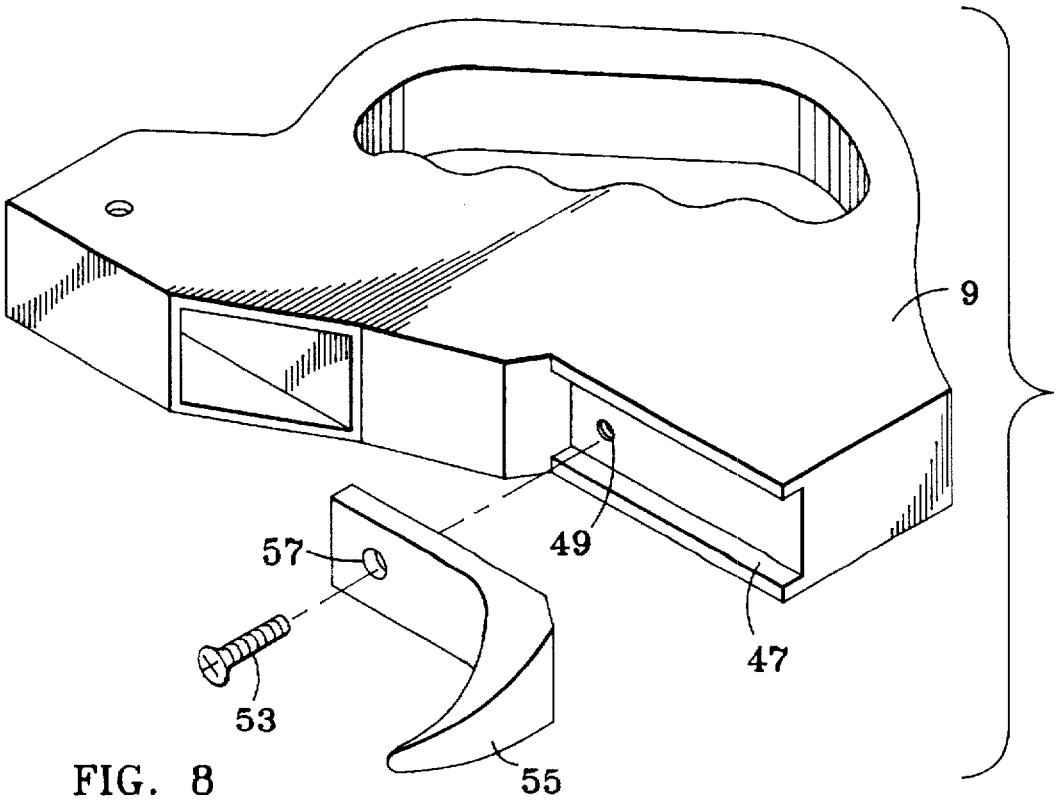
FIG. 8 is a perspective view of the top arm of the second preferred embodiment, and also depicts a perspective view of the second preferred embodiment of the wedge-shaped piece.

FIG. 8 discloses a second preferred embodiment of the present invention. In this embodiment, the wedge-shaped piece 55 is tapered and curved in a similar fashion to that in the first preferred embodiment. However, this embodiment includes an L-shaped curve at its central region with a rectangular portion at its far end (the end most remote from the tip 45) as shown, and similarly to the first preferred embodiment (FIG. 5), widens and thickens from the tip 45 towards its central region. This piece is attached to the indentation 47 in the first arm 9 by inserting a screw 53 through hole 57 and into hole 49.

The foregoing description of the preferred embodiments of this invention has been presented for purposes of illustration and description. It is not intended to be exhaustive or to limit the invention to the precise form disclosed, and obviously many modifications and variations are possible in light of the above teaching. Such modifications and variations that may be apparent to a person skilled in the art are intended to be included within the scope of this invention as defined by the accompanying claims.

What is claimed is:

1. A device for removing staples of given width and leg length, comprising:

a first arm, pivotally attached to a second arm at a pivot point, said first arm including a wedge-shaped piece having a tip at one end, a second end, and a central region between said one end and said second end, and said second arm including a plate with a flat edge shaped to conform to said wedge-shaped piece when the two arms are pivoted together, wherein said wedge-shaped piece varies in width such that it is narrowest at its tip and becomes gradually wider toward its central region; wherein said wedge-shaped piece varies in thickness such that it is narrowest at its tip and becomes gradually thicker toward its central region; wherein a front surface of said wedge-shaped pieced is curved in an arc with a radius of curvature determined such that the origin of the arc coincides substantially with the position of said pivot point; wherein at a point of closest proximity between said wedge-shaped piece and said flat edge of said plate when the two arms are pivoted together, said plate is affixed to the second arm along a first plane substantially perpendicular to a second plane tangent to said front surface of said wedge shaped piece; and wherein at said central region, the sum of said width plus twice said thickness of said wedge-shaped piece exceeds the total sum of the width plus twice the leg length of said staples which said device is to be used to remove; whereby when the first and second arms are pivoted together, said front surface of said wedge-shaped piece and said flat edge of said plate closest to said front surface will remain at a small, substantially fixed distance from one another as said wedge-shaped piece moves past said plate.

2. The device of claim 1, including a spring at an end of said arms, wherein the arms are held apart at an angle by the bias of the spring.

3. The device of claim 1, wherein said plate extends past the end of said second arm.

4. The device of claim 1, including a hand grip attached at both ends of said first arm.

5. The device of claim 4, wherein said finger guard comprises an arch over said series of depressions.

6. The device of claim 1, including a spring biasing said first and second arms.

7. The device of claim 6, wherein said spring is positioned inside said first arm.

8. The device of claim 1, including a means for shielding the user's fingers.

9. The device of claim 1, wherein at said central region of said wedge-shaped piece, the sum of said width of said wedge-shaped piece plus twice the thickness of said wedge-shaped piece exceeds 22 millimeters.

10. The device of claim 1, wherein said plate is metallic.

11. The device of claim 1, wherein said first arm includes a series of depressions for accommodating a user's fingers.

12. The device of claim 1, wherein said plate is composed of hard material.

13. The device of claim 8, wherein said spring is positioned inside said second arm.

14. The device of claim 1, wherein said wedge-shaped piece is a solid, wedge-shaped blade.

15. The device of claim 1, wherein said first arm includes a series of four shallow grooves and an arch extending from one end of said grooves to the other end of said grooves.

16. The device of claim 1, wherein said first arm further comprises a first end and a second end, and a female slot proximate said first end; wherein said second arm further comprises a first end and a second end, said second arm being pivotally attached to said first arm at said pivot point, inside said female slot; and wherein said wedge-shaped piece is proximate to said second end of said first and said plate is proximate to said second end of said second arm

17. A device for removing staples of given width and leg length, comprising a wedge-shaped piece and a plate, wherein:

said wedge-shaped piece and said plate pivot with respect to one another about a common pivot point; wherein a front surface of said wedge-shaped pieced is curved in an arc with a radius of curvature determined such that the origin of the arc coincides substantially with the position of said pivot point; and wherein at a point of closest proximity between said wedge-shaped piece and a flat edge of said plate when said wedge-shaped piece and said plate are pivoted together, said plate is aligned along a first plane substantially perpendicular to a second plane tangent to said front surface of said wedge shaped piece; whereby said front surface of said wedge-shaped piece and said flat edge of said plate closest to said front surface will remain at a small, substantially fixed distance from one another as said wedge-shaped piece and said plate pivot past one another.

18. The device of claim 17, said wedge-shaped piece having a tip at one end, a second end, and a central region between said one end and said second end; wherein said wedge-shaped piece varies in width such that it is narrowest at its tip and becomes gradually wider toward its central region; wherein said wedge-shaped piece varies in thickness such that it is narrowest at its tip and becomes gradually thicker toward its central region; and wherein at said central region, the sum of said width plus twice said thickness of said wedge-shaped piece exceeds the total sum of the width plus twice the leg length of said staples which said device is to be used to remove.

19. A method for removing staples of given width and leg length, comprising:

pivoting a wedge-shaped piece and a plate with respect to one another about a common pivot point; wherein a front surface of said wedge-shaped pieced is curved in an arc with a radius of curvature determined such that the origin of the arc coincides substantially with the position of said pivot point; and wherein at a point of closest proximity between said wedge-shaped piece and a flat edge of said plate when said wedge-shaped piece and said plate are pivoted together, said plate is aligned along a first plane substantially perpendicular to a second plane tangent to said front surface of said wedge shaped piece; whereby said front surface of said wedge-shaped piece and said flat edge of said plate closest to said front surface will remain at a small, substantially fixed distance from one another as said wedge-shaped piece and said plate pivot past one another.

20. The method of claim 19, said wedge-shaped piece having a tip at one end, a second end, and a central region between said one end and said second end; wherein said wedge-shaped piece varies in width such that it is narrowest at its tip and becomes gradually wider toward its central region; wherein said wedge-shaped piece varies in thickness such that it is narrowest at its tip and becomes gradually thicker toward its central region; and wherein at said central region, the sum of said width plus twice said thickness of said wedge-shaped piece exceeds the total sum of the width plus twice the leg length of said staples which said device is to be used to remove.

* * * * *